US006307319B1

(12) United States Patent
Lee

(10) Patent No.: US 6,307,319 B1
(45) Date of Patent: Oct. 23, 2001

(54) PLASMA DISPLAY PANEL AND METHOD FOR MANUFACTURING THE SAME

(75) Inventor: Won-tae Lee, Kyungki-do (KR)

(73) Assignee: Samsung SDI Co., Ltd. (KR)

( * ) Notice: Subject to any disclaimer, the term of this patent is extended or adjusted under 35 U.S.C. 154(b) by 0 days.

(21) Appl. No.: 09/474,015

(22) Filed: Dec. 28, 1999

(51) Int. Cl.[7] ..... H01J 17/49

(52) U.S. Cl. ..... 313/590; 313/582; 313/584; 313/586; 313/587; 257/59

(58) Field of Search ..... 313/590, 582, 313/584, 586, 587, 485, 156, 113, 528, 572, 637, 292, 268, 257; 427/374; 315/169; 257/59

(56) References Cited

U.S. PATENT DOCUMENTS

| | | | | |
|---|---|---|---|---|
| 5,693,958 | * | 12/1997 | Torihara et al. | 257/59 |
| 5,959,403 | * | 9/1999 | Lee | 313/590 |
| 5,962,975 | * | 10/1999 | Lepselter | 313/586 |
| 5,980,991 | * | 11/1999 | Sakamoto et al. | 427/374 |
| 5,990,617 | * | 11/1999 | Kanae et al. | 313/582 |
| 6,218,784 | * | 4/2001 | Jang et al. | 315/169 |

FOREIGN PATENT DOCUMENTS

02000348622 * 12/2000 (JP) ..... 9/50

OTHER PUBLICATIONS

Won–tae Lee, "$LaF_3$ coated MgO protecting layer in AC–Plasma Display Panels," Thin Film Materials and Deposition, 1999 Display Works Manufacturing Technology Conference, Feb. 3–4, 1999 (excerpt consisting of 9 pages).

* cited by examiner

*Primary Examiner*—Charles Bowers
*Assistant Examiner*—Laura M Schillinger
(74) *Attorney, Agent, or Firm*—Burns, Doane, Swecker & Mathis, L.L.P.

(57) ABSTRACT

A plasma display panel (PDP) and a method for manufacturing the same are provided. The plasma display panel (PDP) includes a front substrate and a rear substrate which face each other, upper electrodes and lower electrodes formed on the facing surfaces of the front substrate and the rear substrate in strips to cross each other, a dielectric layer for covering the upper and lower electrodes, barrier ribs formed on the dielectric layer of the rear substrate so that discharge cell is divided, a MgO protective layer deposited on the dielectric layer of the front substrate, and a $LaF_3$ thin film deposited on the MgO protective layer. The $LaF_3$ is deposited by an electron beam vapor deposition method.

3 Claims, 3 Drawing Sheets

PLASMA DISPLAY PANEL AND METHOD FOR MANUFACTURING THE SAME

BACKGROUND OF THE INVENTION

1. Field of the Invention

The present invention relates to a plasma display panel, and more particularly, to a plasma display panel where a $LaF_3$ thin film is deposited on a MgO protective layer of a front substrate and a method for manufacturing the same.

2. Description of the Related Art

In general, display devices are divided into a cathode ray tube and a flat panel display. The flat panel display is thinner and more convenient to carry and consumes less power than the cathode ray tube.

The types of flat panel displays available are a liquid crystal display (LCD), a plasma display panel (PDP), and a field emission display (FED). The PDP is advantageous in embodying a large screen, compensating for the shortcomings of the LCD.

Figure 1:
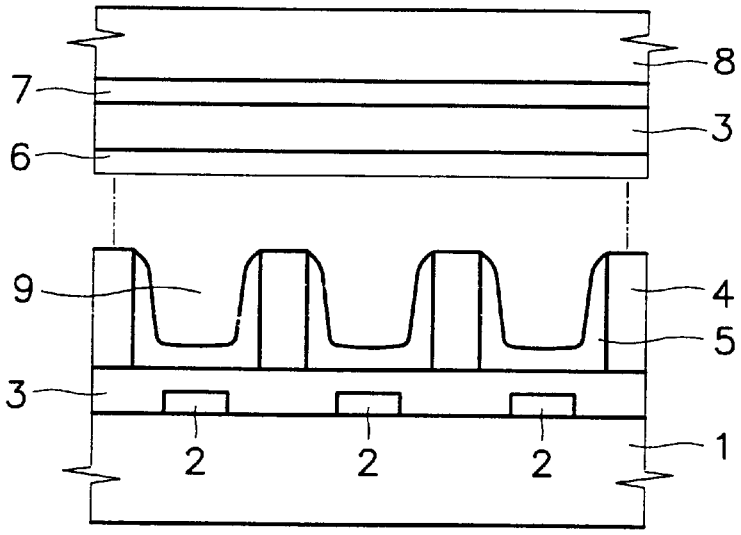
FIG. 1 (PRIOR ART)

A general plasma display panel includes a rear substrate 1 and a front substrate 8 where lower electrodes 2 and upper electrodes 7 in strips are respectively formed on the facing surfaces of the rear substrate 1 and the front substrate 8, as shown in FIG. 1. The rear substrate 1 has a dielectric layer 3 on which barrier ribs 4 are formed. Spaces separated from each other by the barrier ribs 4 which are adjacent to each other form discharge cells 9, which are filled with an inert gas such as Argon. A phosphor layer 5 is formed on the bottom surfaces of the discharge cells 9 and the side walls of the barrier ribs 4. The dielectric layer 3 and a MgO protective layer 6 are sequentially stacked on the front substrate 8. The MgO protective layer 6 reduces a discharge voltage when discharge occurs in the discharge cells 9 and protects the upper and lower electrodes 2 and 7 in the panel.

The operation of the PDP having the above structure will be briefly described.

When a voltage is applied between the upper and lower electrodes 2 and 7, ultraviolet (UV) rays are generated by gas discharge and excite the phosphor layer 5 coated on the internal surfaces of the discharge cells 9. Then, visible rays are emitted from the phosphor layer 5 due to photoluminescence. At this time, colors are displayed by the red, green, and blue phosphor layers 5 formed inside the respective display discharge cells 9.

However, after the MgO protective layer 6 is vaporized and deposited on the dielectric layer 3 formed on the front substrate 8 in a deposition chamber (not shown), when the front substrate 8 is taken from the deposition chamber to the air, the MgO protective layer 6 reacts with moisture in the air, that is, an OH group. The OH group in air is distributed on the MgO protective layer 6 to a thickness of 5 through 20 nm and reacts with MgO. Accordingly, impurities of $Mg(OH)_2$ are formed on the surface of the MgO protective layer 6. $Mg(OH)_2$ causes the discharge to be nonuniform and increases the discharge voltage, to thus deteriorate the performance of the display panel.

Therefore, recently, when the rear and front substrates are sealed to each other in order to minimize the reaction of the MgO protective layer with moisture, a thermal treatment process is performed together with vacuum exhaustion. However, such a process has a low efficiency of removing moisture and the time required for performing the process or the installation cost increases. Also, it is necessary to further include a vacuum device to prevent moisture in air from reacting with the MgO protective layer.

SUMMARY OF THE INVENTION

It is an object of the present invention to provide a plasma display panel which has characteristics of a uniform discharge and a stable voltage and has improved brightness and luminescence efficiency by depositing a $LaF_3$ thin film on a MgO protective layer, thus preventing the MgO protective layer from reacting with moisture in air and being contaminated thereby.

Accordingly, to achieve the above object, there is provided a plasma display panel (PDP), comprising a front substrate and a rear substrate which face each other, upper electrodes and lower electrodes formed on the facing surfaces of the front substrate and the rear substrate in strips to cross each other, a dielectric layer for covering the upper and lower electrodes, barrier ribs formed on the dielectric layer of the rear substrate so that discharge cell is divided, a MgO protective layer deposited on the dielectric layer of the front substrate, and a $LaF_3$ thin film deposited on the MgO protective layer.

Here, it is preferable that the MgO protective layer is formed to a thickness of no less than 500 nm and that the $LaF_3$ thin film is formed to a thickness of 5 through 20 nm.

To achieve the above object, there is provided a method for manufacturing the PDP, comprising the steps of (a) forming upper electrodes and lower electrodes on the facing surfaces of a front substrate and a rear substrate which face each other, in strips to cross each other, (b) forming a dielectric layer for covering the upper and lower electrodes, (c) forming barrier ribs on the dielectric layer of the rear substrate so that discharge cell is divided, (d) forming a MgO protective layer on the dielectric layer of the front substrate, and (e) depositing a $LaF_3$ thin film on the MgO protective layer.

Here, it is preferable that the vapor deposition temperature of the $LaF_3$ thin film is maintained to be equal to the vapor deposition temperature of the MgO protective layer and that the $LaF_3$ is deposited by an electron beam vapor deposition method.

BRIEF DESCRIPTION OF THE DRAWING(S)

Figure 2:
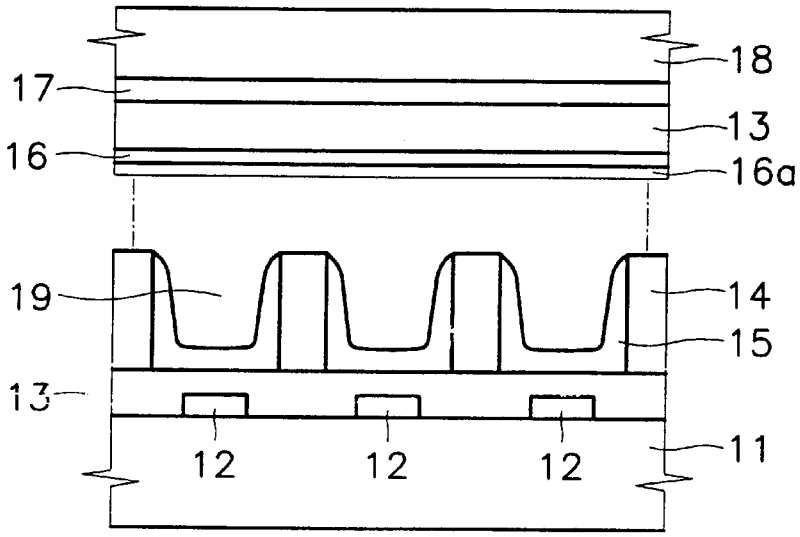
Figure 3:
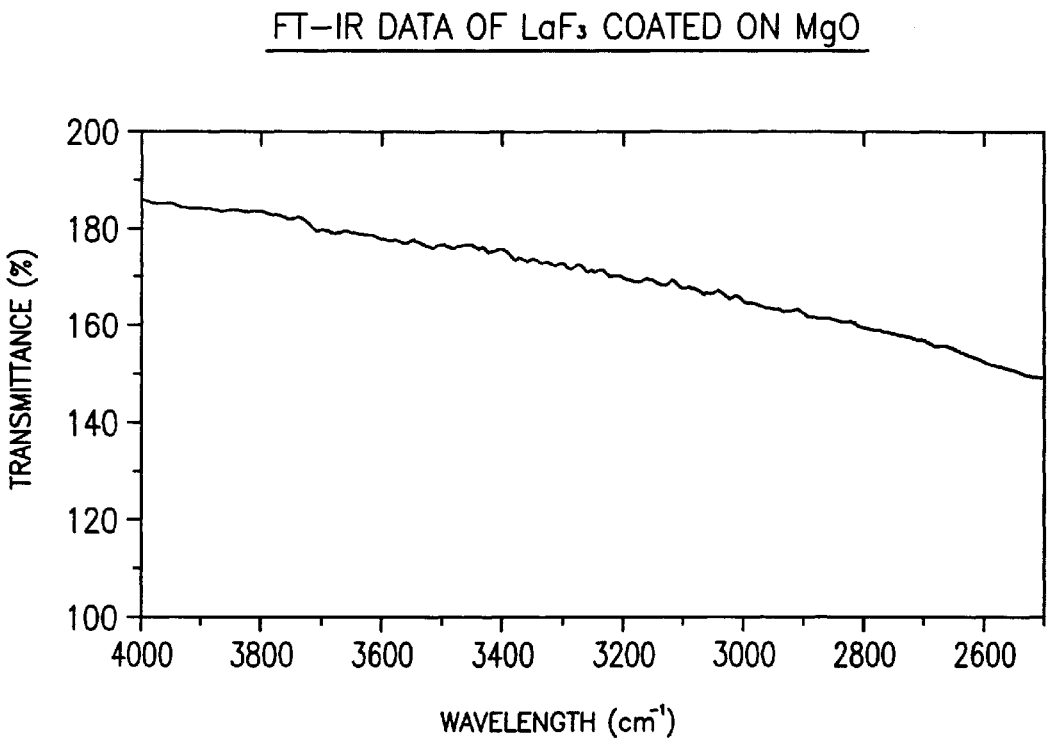
Figure 4:
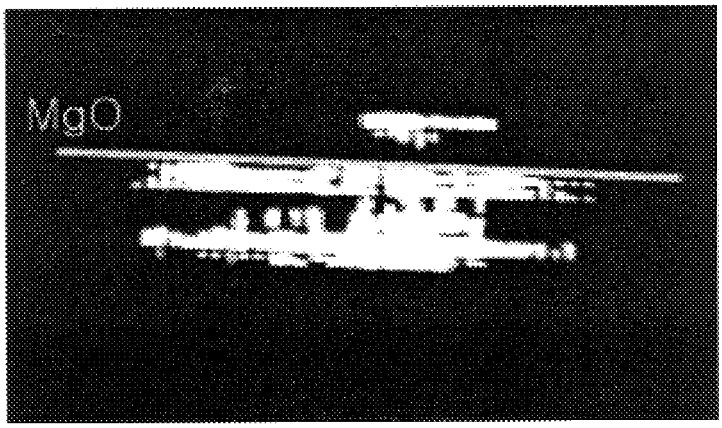
Figure 5:
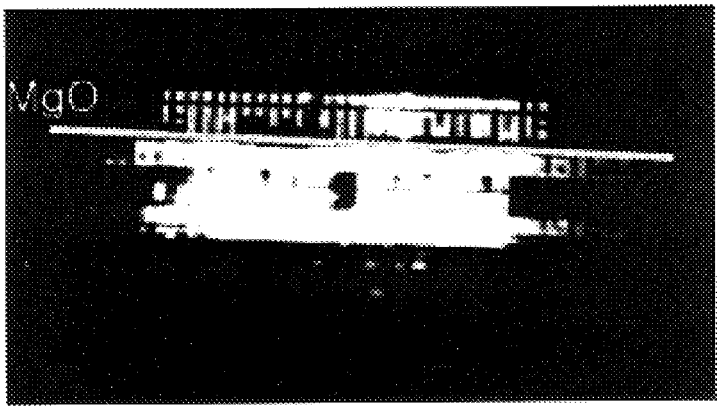
Figure 6:
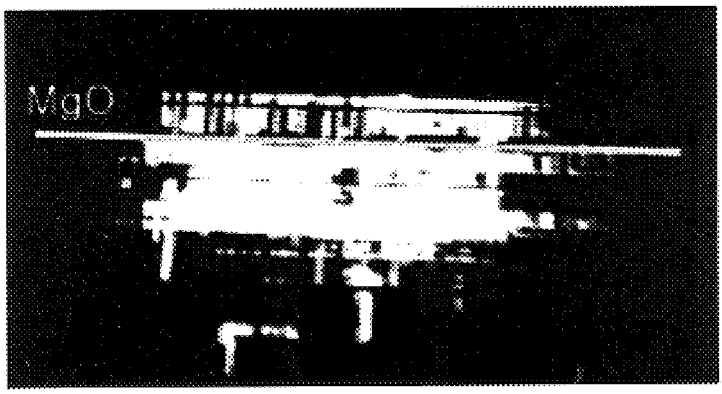

The above object and advantages of the present invention will become more apparent by describing in detail a preferred embodiment thereof with reference to the attached drawings in which:

FIG. 1 is a schematic sectional view of a general plasma display panel;

FIG. 2 is a schematic sectional view of a plasma display panel (PDP) according to a preferred embodiment of the present invention, FIG. 3 is a graph showing the measurement result of the Fourier transform infrared spectroscopy (FT-IR) from which it is determined whether a MgO protective layer deposited with a $LaF_3$ thin film in the PDP according to the preferred embodiment of the present invention reacts to an OH group; and FIGS. 4 through 6 are pictures showing the discharge characteristics of a plasma display panel according to experimental examples of the present invention.

DESCRIPTION OF THE PREFERRED EMBODIMENT

Referring to FIG. 2, a plasma display panel according to a preferred embodiment of the present invention is formed by vapor-depositing a $LaF_3$ thin film 16*a* to a thickness of 5 through 20 nm on a MgO protective layer 16 formed to a thickness of no less than 500 nm, unlike conventional plasma display panels.

The $LaF_3$ thin film 16*a* prevents the MgO protective layer 16 from being exposed to moisture, that is, an OH group. The $LaF_3$ thin film 16*a* prevents the MgO protective layer 16 from reacting with moisture, thus preventing impurities of $Mg(OH)_2$ from being formed on the surface of the MgO protective layer 16. This is because the $LaF_3$ thin film 16*a* does not dissolve in the presence of moisture.

A method for manufacturing the plasma display panel will be described as follows.

Upper electrodes 17 are formed on a front substrate 18. A dielectric layer 13 is formed to a predetermined thickness all over the front substrate 18 on which the upper electrodes 17 are formed. The MgO protective layer 16 is formed by depositing MgO on the dielectric layer 13 formed on the front substrate 18 to a thickness of no less than 500 nm by a sputtering method or an electron beam vapor deposition method. The $LaF_3$ thin film 16*a* is deposited on the MgO protective layer 16 by the electron beam vapor deposition method. Here, the vapor deposition temperature of the $LaF_3$ thin film 16*a* is equal to the vapor deposition temperature of the general MgO protective layer 16.

A rear substrate 11 is manufactured by forming lower electrodes 12 on the rear substrate 11 to be in strips with respect to the upper electrodes 17 on the front substrate 18 and sequentially forming the dielectric layer 13, barrier ribs 14, and a phosphor layer 15 on the lower electrodes 12. Then, a process of sealing the front substrate 18 to the rear substrate 11 by a sealing material (not shown) is performed.

Therefore, when the front substrate 18 where the $LaF_3$ thin film 16*a* is deposited on the MgO protective layer 16 is taken from a deposition chamber (not shown) to the air or kept in the air, the $LaF_3$ thin film 16*a* prevents a chemical reaction caused by contact between moisture and the MgO protective layer 16 from occurring, thus preventing the impurities of $Mg(OH)_2$ from being formed on the surface of the MgO protective layer 16. The $LaF_3$ thin film 16*a* is sputtered and removed when the rear substrate 11 and the front substrate 18 are sealed to each other and a gas is discharged. Therefore, only the MgO protective layer 16 is left on the dielectric layer 13. Namely, the OH group does not react with the surface of the MgO protective layer 16 since the MgO protective layer 16 performs a second electron emission. Therefore, it is possible to expect a uniform and stable discharge effect.

It is noted that the MgO protective layer 16 deposited with the $LaF_3$ thin film 16*a* does not react with the OH group from the fact that the range of fluctuation of a transmittance according to the increase in a frequency is almost uniform as shown by a graph which shows the detection result of the Fourier transform infrared spectroscopy (FT-IR) of FIG. 3. Namely, it is noted that the impurities of $Mg(OH)_2$ are not formed on the surface of the MgO protective layer 16 since the reaction of moisture with the MgO protective layer 16 deposited on an Si substrate is prevented by the $LaF_3$ thin film 16*a* deposited on the MgO protective layer 16. Here, the FT-IR is a device for determining the presence of a material by detecting a unique frequency mode formed in each material and is mainly used for detecting impurities.

The experimental example of the plasma display panel according to the present invention will be described as follows.

FIGS. 4 through 6 are pictures which show the discharge characteristics of a plasma display panel according to the experimental example of the present invention. The plasma display panel is divided into two parts. Namely, in the left part of the picture, a single-layered MgO protective layer is deposited on the dielectric layer formed on the front substrate. In the right part of the picture, the MgO protective layer is formed on the dielectric layer formed on the front substrate and the $LaF_3$ thin film is deposited on the MgO protective layer.

To be more specific, in the right part of the plasma display panel according to the experimental example, the upper electrodes are formed on the front substrate and the dielectric layer, the MgO protective layer, and the $LaF_3$ thin film are sequentially deposited on the upper electrodes. The lower electrodes are formed on the rear substrate in strips to cross the upper electrodes formed on the front substrate, the dielectric layer and the barrier ribs are sequentially formed on the lower electrodes, and the phosphor layer is formed on the dielectric layer among the barrier ribs. Here, the lower electrodes which have an Ag electrode layer, the dielectric layer, and the barrier ribs are formed by a screen printing method. The upper electrodes are formed by depositing an ITO transparent electrode layer on the front substrate and patterning the ITO transparent electrode layer. The MgO protective layer and the $LaF_3$ thin film are deposited by the electron beam vapor deposition method. The gas discharge is generated on such a panel by a Ne-Xe gas without the phosphor layer. Also, all conditions such as a pressure of $10^{-6}$ torr and aging for about twelve hours are kept uniform. Also, a discharge voltage is measured by a sustain discharge and a thin film is deposited by controlling the thickness of the MgO protective layer to be 5 nm by the pressure of $10^{-6}$ torr. The $LaF_3$ thin film is deposited on the MgO protective layer to a thickness of no less than 15 nm and at the same temperature equal to the vapor deposition temperature of the MgO protective layer. The front substrate and the rear substrate which are manufactured as mentioned above are sealed and coupled to each other and exhausted. Then, the discharge characteristic of the panel is investigated.

In the left part of the plasma display panel according to the experimental example, the upper electrodes formed on the front substrate, the dielectric layer, and the MgO protective layer are sequentially deposited to a thickness of 5 nm. Then, the lower electrodes are formed on the rear substrate in strips to cross the upper electrodes formed on the front substrate, the dielectric layer and the barrier ribs are sequentially formed on the lower electrodes, and the phosphor layer is formed on the dielectric layer among the barrier ribs. The front substrate and the rear substrate which are manufactured as mentioned above are sealed to each other and coupled to each other and are exhausted. Then, the discharge characteristic of the panel is investigated.

As shown in FIG. 4, when a discharge voltage of 170 V is applied to the plasma display panel according to the experimental example, the discharge of the right part where the $LaF_3$ thin film is formed on the MgO protective layer is more stable than the discharge of the left part where the single-layered MgO protective layer is deposited. Also, the brightness and the luminescence efficiency of the right part are improved compared to the brightness and the luminescence efficiency of the left part.

As shown in FIGS. 5 through 6, when the discharge voltages of 190 V and 200 V are applied to the plasma display panel according to the experimental example, the discharge of the right part where the $LaF_3$ thin film is formed on the MgO protective layer is more stable than the discharge of the left part where the single-layered MgO protective layer is deposited. This shows that a uniform and stable discharge effect is obtained since it is possible to easily perform the second electron emission in a state where the OH group is not coupled to the surface of the MgO protective layer by depositing the $LaF_3$ thin film on the MgO protective layer.

TABLE 1

| Classification | Overall discharge voltage | Sustain discharge voltage |
|---|---|---|
| Right part (MgO protective layer + $LaF_3$ thin film) | 160 V | 121 V |
| Left part (single-layered MgO protective layer) | 170 V | 130 V |

It is noted from Table 1 that, during the plasma discharge inside the panel, the overall discharge voltage and the sustain discharge voltage are lower in the case where the $LaF_3$ thin film is deposited on the MgO protective layer of the front substrate than in the case where the single-layered MgO protective layer is formed. Accordingly, it is noted that a uniform and stable discharge effect is expected since it is possible to easily perform the second electron emission by forming the $LaF_3$ thin film on the MgO protective layer, thus preventing moisture from reacting with the MgO protective layer, while a high discharge voltage is required in the case where the single-layered MgO protective layer is formed.

Here, the present invention can be applied to all flat panel displays such as field emission displays (FEDs) and cathode ray tubes (CRTs) where the electron emission characteristic is improved by depositing the $LaF_3$ thin film on the thin film from which electrons are emitted.

According to the PDP of the present invention and the method for manufacturing the same, it is possible to improve the second electron emission characteristic by depositing a $LaF_3$ thin film on the MgO protective layer, thus minimizing the amount of the impurities of $Mg(OH)_2$ formed by the reaction between the moisture and the MgO protective layer and to improve the driving characteristic of the display panel by stabilizing the plasma discharge inside the discharge cells. Therefore, a picture display characteristic and the luminescence efficiency are improved and the life of the PDP is prolonged. Also, it is possible to reduce working hours and expenses since thermal treatment equipments for removing the moisture which exists on the MgO protective layer and vacuum equipments for the purpose of keeping the front substrate are not necessary.

What is claimed is:

1. A method for manufacturing the PDP, comprising the steps of:

(a) forming upper electrodes and lower electrodes on the facing surfaces of a front substrate and a rear substrate which face each other, in strips to cross each other;

(b) forming a dielectric layer for covering the upper and lower electrodes;

(c) forming barrier ribs on the dielectric layer of the rear substrate so that discharge cell is divided;

(d) forming a MgO protective layer on the dielectric layer of the front substrate; and (e) depositing a $LaF_3$ thin film on the MgO protective layer.

2. The method of claim 1, wherein the vapor deposition temperature of the $LaF_3$ thin film is maintained to be equal to the vapor deposition temperature of the MgO protective layer.

3. The method of claim 2, wherein the $LaF_3$ is deposited by an electron beam vapor deposition method.

* * * * *